United States Patent [19]

Locher

[11] Patent Number: 5,033,791

[45] Date of Patent: Jul. 23, 1991

[54] CHAIR FRAME

[76] Inventor: Hermann Locher, Schlossweg 71, Dornach, Switzerland

[21] Appl. No.: 598,581

[22] Filed: Oct. 11, 1990

Related U.S. Application Data

[63] Continuation of Ser. No. 334,849, Apr. 6, 1989, abandoned.

[30] Foreign Application Priority Data

Apr. 7, 1988 [CH] Switzerland ..... 1276/88

[51] Int. Cl.[5] ..... A47C 3/00

[52] U.S. Cl. ..... 297/302; 297/300; 297/326

[58] Field of Search ..... 297/300, 301, 302, 303, 297/309, 285

[56] References Cited

U.S. PATENT DOCUMENTS 4,575,150 3/1986 Smith ..... 297/300
4,744,600 5/1988 Inoue ..... 297/300
4,776,633 10/1988 Knoblock et al. ..... 297/300
4,830,431 5/1989 Inoue ..... 297/300

*Primary Examiner*—Peter A. Aschenbrenner

[57] ABSTRACT

A chair frame comprises a seat part and a backrest part. A spring connecting portion, which is fixed by a pivot joint to the free end of a support arm is provided at the knee side of the seat part. To the backrest part is fixed at least one backrest strut, which is mounted by means of a pivot joint on a slide, which is displaceably guided in the support arm. A compression spring is mounted in the support arm. One end of the compression spring is connected to the slide while its other end is mounted by means of a pivot joint in the side walls of the support arm. A lever is connected to the spring connection portion at the knee side. An adjusting screw is connected to the lever. The adjusting screw adjusts the bias of the knee side spring portion of the seat part.

9 Claims, 2 Drawing Sheets

CHAIR FRAME

This is a continuation of copending application(s) Ser. No. 07/334,849 filed on Apr. 6, 1989, abandoned.

BACKGROUND OF THE INVENTION

The present invention relates to a frame for a chair, comprising a seat part and a backrest part, the seat part being supported on a support part provided with a support arm and connected in articulated manner to the backrest part, whilst on the knee side the seat part is supported by means of a joint and on the backrest side by a backrest strut via a spring element on the support arm.

Chair frames having a seat part and a backrest part are known in a number of different constructions. In one frequently used chair frame in which the seat part and backrest part can be pivoted rearwards and downwards, the seat part is articulated to a support arm on the knee side. The support arm is part of the foot or base frame of the chair having a vertical support column, to which the support arm is fixed.

The seat part is connected in either a fixed or an articulated manner to the backrest part. In the latter case the back part is supported by means of a compression spring element, usually a gas pressure spring, on the support arm. This chair frame has been produced in large numbers and has proved satisfactory. However, the manufacturing costs are relatively high, because the forces exerted by a chair user on the seat part and the back part and which are transferred via the support arm into the base frame are considerable and the parts require frequent replacement. In chairs with a pivotable seat part and/or a pivotable back part, it is necessary to connect these two parts by additional connecting elements to the support arm. As these additional connecting elements must be housed with a minimum amount of space being consumed, forces can occur thereon, whose magnitude can significantly exceed the body weight of the chair user. In particular, the spring elements must be designed for such additional forces, which increases manufacturing costs and therefore the chair costs.

The Applicant has developed a chair (EP-A-264029), in which the backrest side support of the seat part and the back part does not take place directly on the spring element, but instead occurs via a movable slide, which is displaceably guided in a parallelogram linkage articulated to the support arm and which is connected to one end of the spring element, whose other end is supported on the parallelogram linkage. Thus, it is possible to significantly reduce the forces on the spring element, so that the latter can be made much smaller. Another advantage is that in the case of this chair frame there is no longer any need to make an adjustment with regards to the differing weight of the chair user. In addition, the connecting elements between the seat part, the back part and the support arm can be kept small, so that the volume required for housing these elements under the seat can be kept correspondingly small.

SUMMARY OF THE INVENTION

It is an object of the present invention to provide a chair frame in which spring tensions which occur are of a similar small magnitude to those in the construction with the parallelogram linkage, but the chair frame has a substantially simpler construction.

According to the invention this and other objects of the invention are attained by the chair frame, in which the knee side joint is constructed as an elastic or spring connecting portion whose spring tension is adjustable and the back rest strut is supported by means of a spring element on the support arm.

The spring element may be a compression spring, e.g. a gas pressure spring, whereof one end is fixed by means of a pivot joint to the support arm and the other end is connected by means of a further pivot joint to the back rest strut, the further pivot joint being movably supported on the support arm. Thus, as a result of the direct supporting of the backrest strut on the slide, it is possible to omit the parallelogram linkage. Admittedly the forces which occur are somewhat greater as a result of this, so, that it is necessary to have a possibility of adjusting the spring connecting portion for adapting to the weight of the chair user, but the chair frame construction is much simpler.

Two exemplified embodiments of the invention are described hereinafter relative to the drawings.

DETAILED DESCRIPTION OF THE PREFERRED EMBODIMENT

Figure 1:
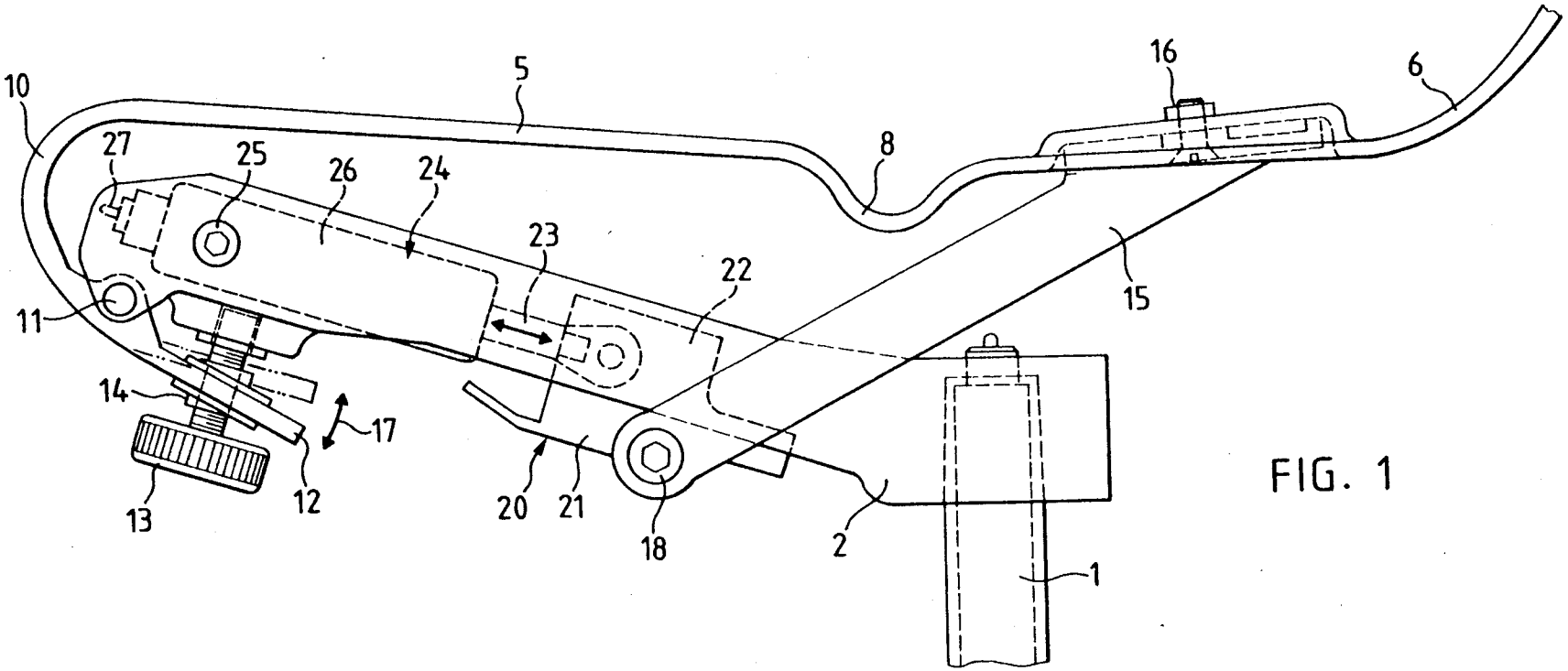
FIG. 1 is a side view of the chair in which parts of the backrest and foot frame have been omitted.

In FIG. 1, there is shown a support column of a not shown foot or base frame of a chair, to which is fixed a support arm 2, which slopes slightly against the knee side of the chair. The chair frame has a seat part 5, to which is connected a backrest part 6 partially shown in FIG. 1. Seat part 5 and backrest part 6 can be connected either rigidly or in an articulated manner to one another. The backrest part 6 is connected by a resilient or spring connecting portion 8 to seat part 5, i.e. part 6 has an additional pivotability compared with that of seat part 5, but this acts against the pivoting movement corresponding to the spring tension of the spring connecting portion 8.

On the knee side, seat part 5 is guided in an arc round the support arm 2, accompanied by the formation of a resilient or spring connecting portion 10 which is fixed on the underside of arm 2 to a pivot joint 11. The spring connecting portion 10 has an extension, which is constructed as a lever 12 extending from the pivot joint 11 towards the support column. An adjusting screw 13 is mounted on lever 12. Since lever 12 changes its position and inclination, a threaded ring 14 is pivotably mounted in lever 12, and into it is screwed the adjusting screw 13, which is mounted in rotary manner on the underside of support arm 2. By turning the adjusting screw 13, lever 12 can be moved in the direction of double arrow 17 towards or away from the support arm 2, which increases or decreases the bias of the knee side spring connecting portion 10.

One or two backrest struts 15 are arranged on the underside of backrest part 6 and are fixed to the latterby a rigid connection, e.g. a screw connection 16. The two backrest struts 15 are arranged on both sides of the support arm 2 and fixed by a pivot joint 18 to a slide 20. Slide 20 is arranged in the interior of support arm 2 and has a lower part 21, which projects out of the support arm 2 and on which is arranged the pivot joint 18. Support arm 2 is a hollow profile, e.g. a square tube, on whose underside is provided a longitudinal slot. Slide 20 comprises an inner part 22 located within the support arm 2 and an externally positioned lower part 21. The two parts are interconnected, e.g. by a screw extending through the longitudinal slot. Thus, slide 20 can be guided in a substantially clearance-free manner on the underside of support arm 2. A piston rod 23 of a gas spring 24 is applied to inner part 22. Cylinder 26 of gas spring 24 is supported by means of two pivot joints 25 in the side walls of support arm 2. For operating a control rod 27 of gas spring 24, a non-shown actuating means is provided for the chair user. In connection with slide 20 and the operation of gas spring 24, reference is made to the aforementioned earlier dated applicant's patent.

Figure 2:
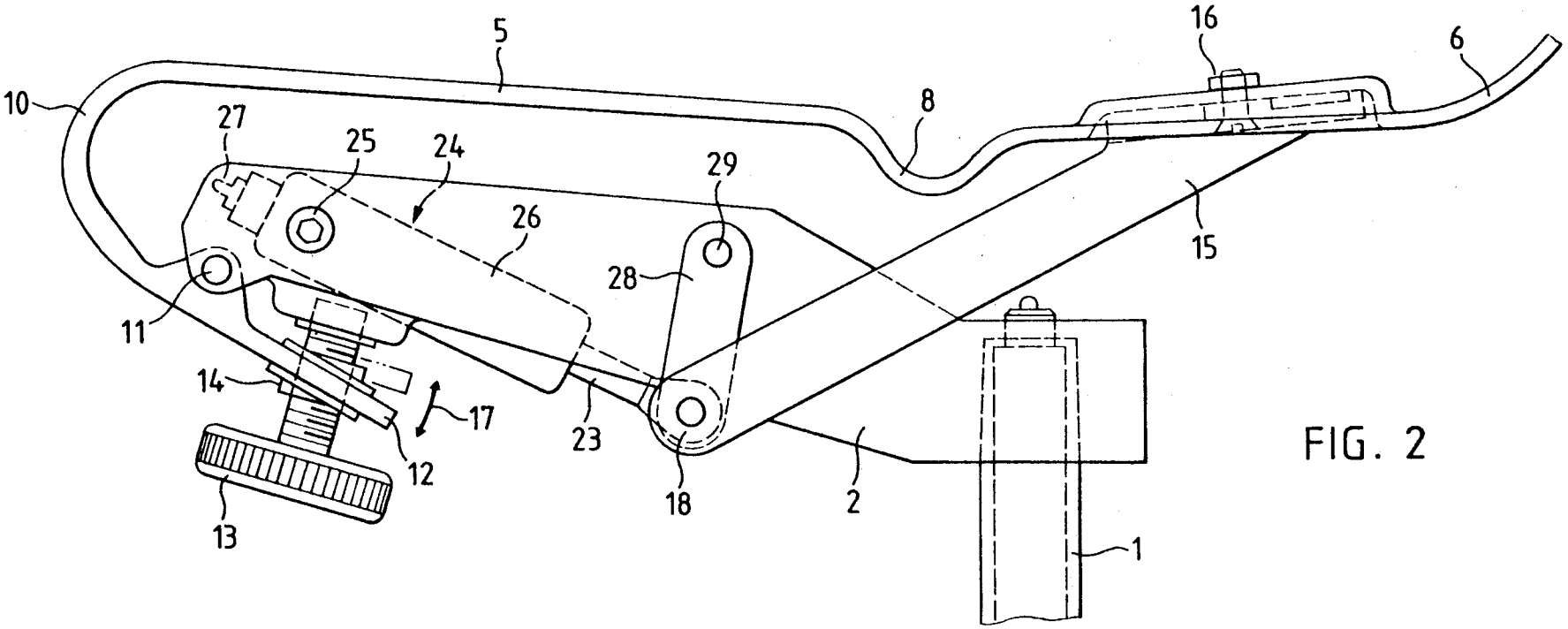
FIG. 2 is a side view of another embodiment of the chair frame.

In FIG. 2, slide 20 is replaced by one or two link plates 28, whereof one end is supported by a pivot joint 29 on support arm 2 and the other end is connected by means of the pivot joint 18 to the gas spring 24 and the backrest strut or struts. The other references coincide with those of FIG. 1.

The described chair frame is characterized by its relatively great simplicity. Support arm 2 and the gas spring mounted therein, as well as the slide 20 or link plate 28 guided thereon, together with the backrest struts 15 supported thereon constitute the essential components.

If the chair is always used by the same person, it is merely necessary to adjust once and for all the spring tension of the knee side spiral spring joint 10 with the adjusting screw 13. It is then merely necessary to use the actuating mechanism for releasing or locking gas spring 24.

What is claimed is:

1. A chair frame comprising:

(a) a seat part having a rear portion and a downwardly curved elastic knee-side portion;

(b) a backrest part having a lower end that is attached to the rear portion of said seat part;

(c) a base column; and (d) a support structure including at least one backrest strut having a top end and a bottom end;

a support arm having a front portion and a rear portion and the rear portion being fixedly attached on said base column;

a slide having a top portion and a bottom portion and being glideably located on the rear portion of said support arm;

a spring having a front end and a rear end and the front end being pivotably mounted to the front portion of said support arm and the rear end of the spring being pivotably mounted to the top portion of said slide;

the top end of said backrest strut being fixedly attached to said lower end of said backrest part;

the bottom end of said backrest strut being pivotably mounted to the bottom portion of said slide;

the front portion of said support arm being pivotably mounted to the curved knee-side end of said seat part.

2. Chair frame according to claim 1, wherein said backrest part is resiliently attached to said seat part.

3. Chair frame according to claim 1, wherein said support arm of the said support structure is a hollow profiled structure having a longitudinal opening on the underside.

4. Chair frame according to claim 3, wherein said spring and said slide are located in the interior of said hollow support arm.

5. Chair frame according to claim 1, wherein said spring is a compression spring with an integral piston rod and the connection of the spring to the slide is accomplished by said piston rod.

6. Chair frame according to claim 1, wherein said slide is at least one link plate having a top portion and a bottom portion.

7. Chair frame according to claim 6, wherein the top portion of said link plate is rotatably connected to said support arm and the bottom portion is rotatably connected to the bottom end of said backrest strut and the rear end of the spring.

8. Chair frame according to claim 1, wherein the downwardly curved elastic knee-side portion of said seat part extends beyond the attachment to said support arm and forms a lever.

9. Chair frame according to claim 8, wherein an adjustment screw extending perpendicularly between said lever and said support arm adjusting the tension of the curved elastic knee-side portion of said seatpart.

* * * * *